United States Patent [19]

Cannon et al.

[11] 3,998,366

[45] Dec. 21, 1976

[54] FORMER FOR MOULDING FLARED SKIRTS

[75] Inventors: Cyril George Cannon; John Anthony Carter, both of Harrogate, England

[73] Assignee: Imperial Chemical Industries Limited, London, England

[22] Filed: Dec. 31, 1975

[21] Appl. No.: 645,656

[30] Foreign Application Priority Data

Jan. 8, 1975 United Kingdom ..... 762/75

[52] U.S. Cl. ..... 223/68

[51] Int. Cl.[2] ..... A41H 5/00

[58] Field of Search ..... 223/66, 68, 70, 61, 223/72, 73

[56] References Cited

UNITED STATES PATENTS 3,866,807 2/1975 Parr ..... 223/68

*Primary Examiner*—G. V. Larkin

*Attorney, Agent, or Firm*—Cushman, Darby & Cushman

[57] ABSTRACT

A former for moulding a fabric garment shape, said former having hip and waist planes corresponding to a person's body and comprising at least seven members arranged in two groups about an imaginary common line, such that the first group comprising at least 6 interconnected members define a geometrical figure selected from the group consisting of a quadrilateral, pentagon and hexagon at the waist-plane and a hexagon at the hip-plane, and the second group comprising at least one member located between the first group extending at least from the hip-plane to the waist-plane.

4 Claims, 2 Drawing Figures

FORMER FOR MOULDING FLARED SKIRTS

Figure 1:
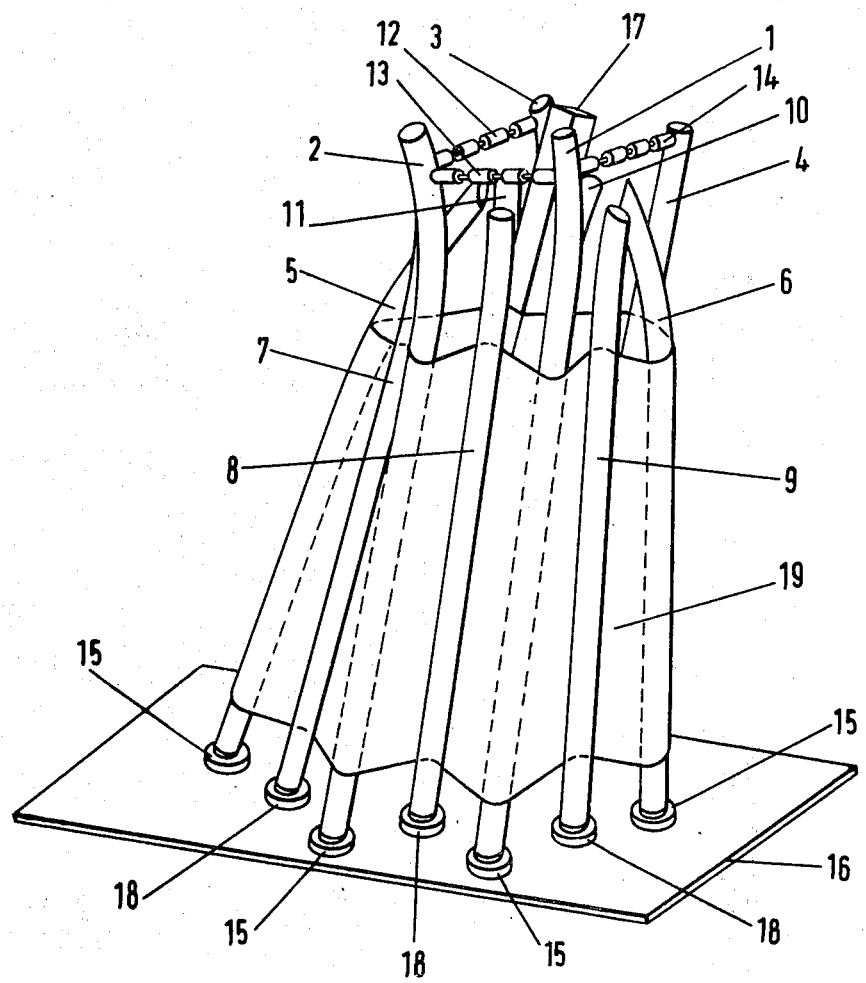

The present invention relates to a former for moulding a garment shape from fabric.

By the term "garment shape"is meant a length of fabric which has been shaped, and which may with or without further processing, for example the addition of pockets and/or motifs, and finishing, be used as an article of apparel.

For a garment to be comfortable and stylish, it is necessary for it to have a shape approximating to that part of the body for which it is designed. When the garment is made from fabric in roll form, the shape of the garment is obtained by cutting out numerous panels which are subsequently seamed together, for example, by sewing. This method, which has been used over many centuries, is not only time consuming but also wasteful since the material remaining between panels cannot be utilised. The wastage is increased further in the case where it is necessary to cut the panels from a particular part of a long repeat pattern in order to give the resulting garment an attractive appearance. This is particularly so in the production of garments having a flared skirt in which godets cut on the bias are inserted to give the flares.

New methods of garment manufacture are now being developed. One such method is the moulding of garments or parts of a garment wherein the fabric is shaped without the need for panels, darts, tucks or other similar devices. In this process the fabric is moulded on a former having the correct shape and dimensions necessary to produce the required size of garment. Fabric containing thermoplastic fibres, such as those formed from polyamides and polyesters, are particularly suitable for moulding since a shape stable to subsequent wear and cleaning may be obtained by shrinking and/or stretching the fabric on an appropriate former at a temperature sufficiently high to set the fabric but not to melt the thermoplastic fibres. Formers have been developed for moulding skirts but such formers can only produce a limited range of styles and cannot be used to produce a flared skirt equivalent to one produced by the conventional cut and sew method in which biased cut godets are inserted.

The invention seeks to provide a former for moulding garment shapes in which portions of the fabric are flared in a manner similar to that achieved in a conventional tailored garment by the insertion of godets. It is particularly suitable for moulding flared skirts.

Accordingly, the present invention provides a former for moulding a fabric garment shape, as hereinbefore defined, the former having hip and waist planes corresponding to a person's body, comprises at least seven members arranged about an imaginary common line to form two groups, the first group, comprising at least six interconnected members, the axes of which define a quadrilateral, pentagon, or hexagon at the waist plane and a hexagon at the hip-plane, and the second group comprising at least one member located between the first group and the imaginary common line, the members of the first group extending at least from the hip plane to the waist plane.

The second group of members located between the first group of members and the imaginary common axis may comprise one member only, but preferably it comprises several members. The actual number of members in this second group, and their disposition relative to the first group of members may be varied according to the particular effect required, for example, the number and depth of flares.

The former of the present invention may form part of a larger former, for example, it may form the lower portion of a larger former for moulding dresses and coats such as that described in U.S. Pat. No. 3,866,807.

The members may be solid or hollow in construction, and of any convenient cross-section and preferably they should have no sharp projections which could make contact with a fabric preform placed on the former. They may be formed from partially curved plate, the degree of curvature possibly varying along the length of the member but more conveniently they may be formed from a rod or tube having a circular cross-section with a radius of at least half of one inch. Formers made from members of very large cross-section will have restricted use, being unsuitable for the production of garment shapes of small size. Preferably at least part of each member is curved along its length. Generally the members are rigid in order to withstand any stresss produced during the moulding of the garment shape.

For convenience, the lower ends of the members may be adjustably mounted on a base, and preferably the members are terminated by ball and socket joints which engage in holes in a perforated base. At least some of the members may also be adjustably mounted along their length to a pillar which is also mounted at one end on the base.

The members of the former may show a tendency to rotate about their own axis, and this may be overcome by fitting an anti-rotation device between two or more members.

The former of the present invention may be used for converting a preform into a garment shape by a moulding operation. A preform is prepared having a shape approximating to that of the garment shape required. It may simply be a shaped tube of fabric, but more complex preforms may be used having, for example, a front, rear, or side opening closed by a zip fastener, buttons, or snap fasteners. Where the preform has an opening closed by buttons or snap fasteners it is desirable to temporarily seam the opening to prevent gaping when stretched on the former. The preform may be directly knitted or woven into shape, or may be produced by cutting and sewing knitted, woven, or non-woven fabric. The preform is then placed on the former so that is passes around the outer edges of the first group of members and around the inner edge(s) of the or, where there are more than one member, at least some or all of the members of the second group. Care is taken to ensure that the preform is positioned correctly and free from wrinkles, and the preform is subsequently set so that it retains the required shape and dimensions on removal from the former.

Fabrics suitable for making a preform include woven, knitted, and non-woven fabrics made from thermoplastic fibres, e.g. from nylon, polyesters, or acrylic based polymers, from non-thermoplastic fibres, e.g. cotton and wool, or even a combination of the two types of fibres. Other suitable fabrics include coated fabrics and sheet material provided, of course, that the material can be deformed and set. The construction of the fabric should be such so that it can be deformed but without undue damage. Preferably the deformation is by shear distortion rather than by stretch.

Setting of the preform on the former may be by any process, either chemical or physical, which modifies the fabric so that it essentially retains its dimensions when removed from the former. The fabric should substantially retain its moulded dimensions during subsequent further processing and use, including laundering. Heating below the melting temperature is a very suitable means of setting preforms made from fabrics containing thermoplastic fibres and where the faric contains polyester fibres the heating should be to a temperature at least equal to the second order transition temperature (Tg) of the polyester fibres. Chemical means of setting include the application of resinous material, for example, those well known in the textile trade for producing crease-resist fabrics, or breaking and reforming chemical bonds within the fibres, for example, by the use of well known chemicals used for the permanent pleating of woollen articles.

Figure 2:
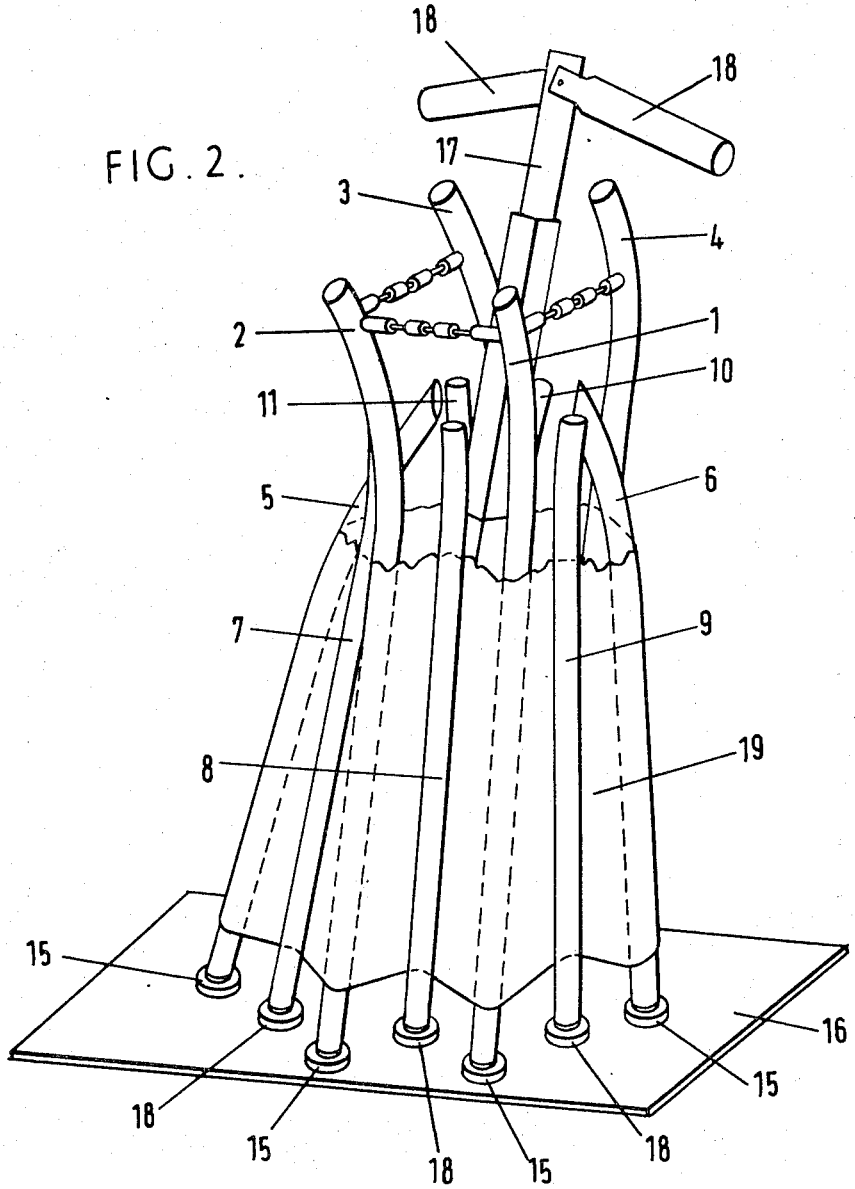

Two embodiments of the invention will now be described by way of example with reference to the accompanying drawings in which FIG. 1 illustrates a former for moulding a flared skirt, and FIG. 2 shows a former for moulding a dress having a flared skirt.

Referring to the drawings, the former illustrated in FIG. 1 is suitable for moulding a flared skirt having hip and waist planes. The former comprises eleven tubular members arranged about an imaginary common line (not shown) to form two groups. The axes of the first group of members 1, 2, 3, 4, 5 and 6 define hexagons at the waist and hip levels. Members 1, 2, 3 and 4 are adjustably interconnected at their upper ends by tie assemblies 12, 13 and 14 each having left and right handed threaded rods connected together through universal joints. The lower ends of this first group of members rest in spherical cups 15 which are slideably mounted on a base 16. Also mounted on the base is an angled pillar 17 to which are adjustably mounted via connecting struts (not shown) the side members 5 and 6. To prevent rotation of the tubular members about their own axis an anti-rotation device (not shown) is formed by welding a separate boss to members 3 and 4, and linking each boss to an anchor block via a U-link.

A second group of tubular members 7, 8, 9, 10 and 11 are located between the first group and the imaginary common line. Their upper ends are adjustably interconnected by tie-assemblies (not shown), their lower ends rest in cups 18 slideably mounted on the base 16, and rotation of the members prevented by an anti-rotation device (not shown) in the same manner as the first group of members.

The curvature of the tubular members is designed to give the required shape of the ultimate moulded garment.

The former of FIG. 2 is similar to that of FIG. 1 except that the tubes 1, 2, 3 and 4 and the pillar 17 are extended upwards. The pillar 17 bears shoulder tubes 20. This type of former is suitable for moulding a dress having a flared skirt.

To mould a garment shape on either former of FIGS. 1 or 2, a preform having an appropriate shape is prepared from suitable faric. The preform 19 is then placed on the former, so that it contacts the outer edges of the members of the first group and the inner edges of the members of the second group so that a series of convolutions are formed as shown in the figures. This may be achieved by lifting the former off its base, threading the preform around the members, and returning the former to its base. The members are then adjusted to produce the required shape of the preform by tensioning the fabric and the preform is subsequently set, for example, by heating the preform on the mould where the preform comprises thermoplastic fibres.

What we claim is:

1. A former for moulding a fabric garment shape, said former having hip and waist planes corresponding to a person's body and comprising at least seven members arranged in two groups about an imaginary common line, such that the first group comprising at least six interconnected members define a geometrical figure selected from the group consisting of a quadrilateral, pentagon and hexagon at the waist-plane and a hexagon at the hip-plane, and the second group comprising at least one member located between the first group and the imaginary common line so that a fabric can be contacted with the outer edges of the members of the first group and with the inner edges of the members of the second group to form a series of convolutions in the fabric, the members of the first group extending at least from the hip-plane to the waist-plane.

2. A former as in claim 1 including a base and means adjustably mounting the members on the base.

3. A former as in claim 1 including a pillar, at least some of the members being adjustably mounted along their length to the pillar.

4. A former as in claim 1 wherein at least part of each member is curved along its length.

* * * * *